US005494332A

United States Patent [19]

Daniel

[11] Patent Number: 5,494,332

[45] Date of Patent: Feb. 27, 1996

[54] CHAIR WITH ORTHOPEDIC BACK SUPPORT

[76] Inventor: Machfud Daniel, 8 Yoel Street, Petach Tikva, Israel

[21] Appl. No.: 247,111

[22] Filed: May 19, 1994

[30] Foreign Application Priority Data

May 19, 1993 [IL] Israel ..... 105750

[51] Int. Cl.[6] ..... A47C 7/46

[52] U.S. Cl. ..... 297/284.4; 297/284.7

[58] Field of Search ..... 297/284.4, 284.7, 297/284.8; 5/640, 636, 633, 464, 465; 606/240, 242

[56] References Cited

U.S. PATENT DOCUMENTS

| | | | |
|---|---|---|---|
| 3,642,319 | 2/1972 | Berchicci | 297/284.4 |
| 3,719,185 | 3/1973 | Hanes | 606/240 X |
| 3,724,144 | 4/1973 | Schuster | 297/284.4 |
| 4,232,898 | 11/1980 | Bodrero | 297/228.1 |
| 4,844,544 | 7/1989 | Ochiai | 297/408 |
| 4,950,032 | 8/1990 | Nagasaka | 297/284.4 |
| 5,237,713 | 8/1993 | Prager | 5/636 X |

FOREIGN PATENT DOCUMENTS

| | | | |
|---|---|---|---|
| 1199756 | 7/1970 | United Kingdom | 297/284.4 |

*Primary Examiner*—Peter M. Cuomo
*Assistant Examiner*—Anthony Barfield
*Attorney, Agent, or Firm*—Lowe, Price, LeBlanc & Becker

[57] ABSTRACT

A chair includes a seat back containing a pillow through which extends a non-circular shaft. Rotation handles at opposite ends of the shaft enable rotation of the pillow to a desired arch. The pillow is located underneath an outer flexible covering of the seat back.

4 Claims, 1 Drawing Sheet

CHAIR WITH ORTHOPEDIC BACK SUPPORT

TECHNICAL FIELD

The present invention relates to a chair with an orthopedic back support. More specifically the present invention relates to a chair with a back support which can be designed and adjusted according to the shape and arches of the sitter's back.

BACKGROUND ART

A person's spine is not straight and its shape is slightly arched and concave. The arch or indentation at the bottom of the back changes from one person to the other. There are those with a small indentation at their lower back and others with a larger indentation. The pressure on a person's back when their sitting posture is wrong is very great and may cause irreversible damage. Therefore using a pillow at the arch of the lower back according to the desired size gives comfort and is healthy for the back and prevents the creation of pressure at the lower back arch. The back is constructed of a chain of vertebrae and by aligning the arch of the chair (small or large) with the height of the arch it is possible to reach a maximum adjustment of the back's arch with the support's arch. Using the chair according to the invention is particularly beneficial to people sitting for hours on end and prevents the creation of pressure on the lower back's vertebrae.

SUMMARY OF THE INVENTION

The present invention relates to a chair with an orthopedic back support which can be adjusted to the arches of the sitter's back such that at the back's support there is a pillow with a means to align and set the vertical height of the pillow and a means to turn the pillow around its axis such that the pillow's axis is not symmetrical to the pillow's circumference and such that the distance between the circumference to the pillow's axis changes with the change in the rotation's angle and the extent of rotating the pillow around its axis determines the extent of the arch and the bulge of the pillow towards the sitter's back. According to the invention, the chair support together with the pillow can be used as support for the back of the neck as well as a support for the lower back.

The pillow can be made of soft and flexible material or from rigid material such as plastic. The pillow can also be made of rigid material at its center and soft and flexible material at its edges.

BEST MODE FOR CARRYING OUT THE INVENTION

Figure 1:
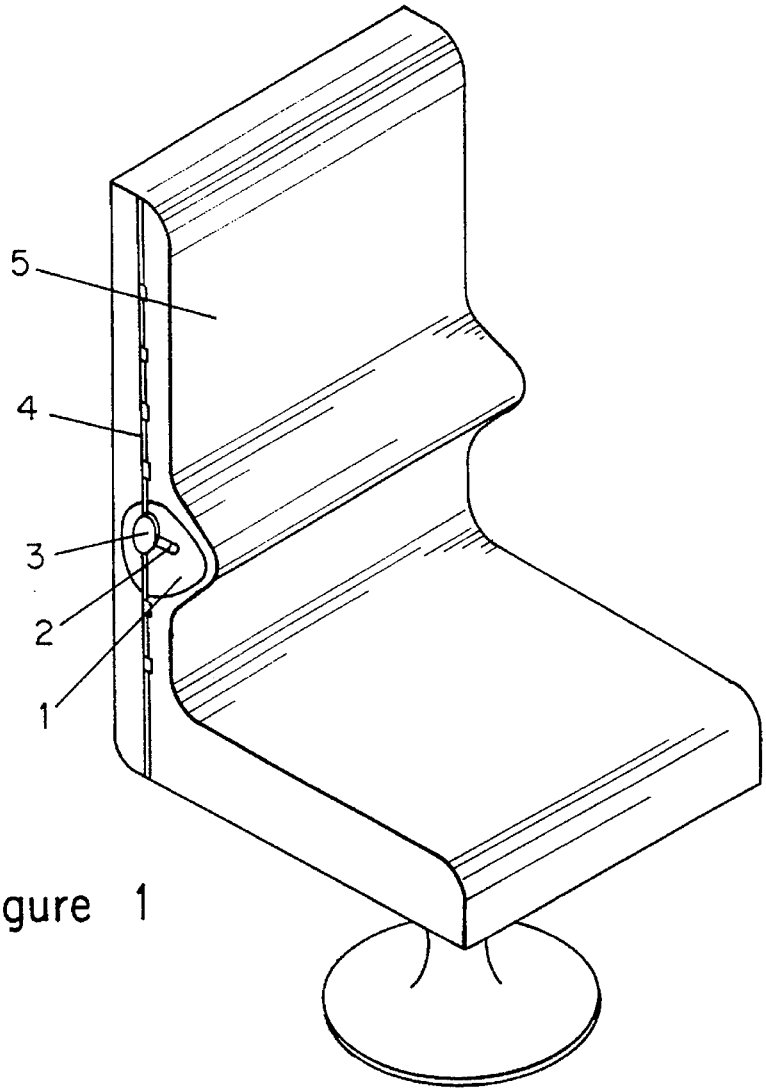
FIG. 1 is an isometric view of the chair according to the invention.

FIG. 1 illustrates an isometric view of the chair. The support (5) is made of cloth or any other flexible material within which is the pillow (1) with a hard shaft with longitudinal cut (2) passing along the pillow's length. The shaft is not rounded but of a longitudinal cut so as to prevent its sliding off when the pillow is rotated. Rotation handles (3) at both sides of the shaft enable rotation of the pillow to the desired arch. The pillow is located underneath the outer flexible covering of the chair within the space between the frontal and back covers of the chair. An opening with anchorage bays at its length passing through the sides of the chair's support enables lowering and raising the pillow to the desired height and anchoring and setting it at a given height.

Figure 2A:
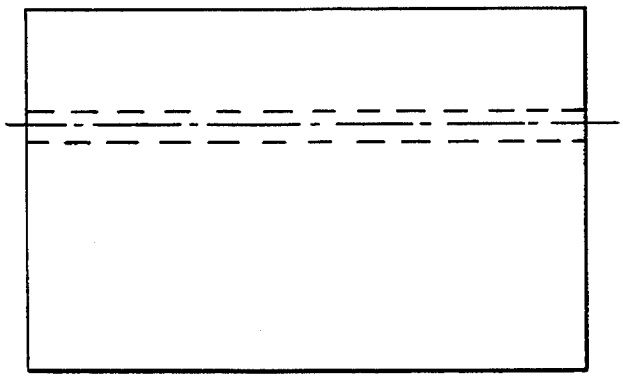
FIG. 2*a* is a side view of the pillow according to the invention.

FIG. 2*a* illustrates the pillow from a side view. The pillow (1) is made of a rigid, flexible or semi-flexible material, caught onto the rigid longitudinal shaft of the axis (2) passing at its length. At each of the four perpendicular (90°) directions there is a different shaped arch at a different length from the pillow axis.

Figure 2B:
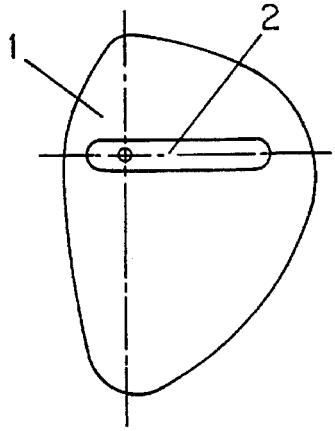
FIG. 2*b* is a longitudinal view of the pillow according to the invention.

FIG. 2*b* illustrates the pillow from a longitudinal view wherein the dotted lines mark the axis of the pillow.

I claim:

1. An orthopedic chair comprising: a seat;

a back support having a front support surface projecting upward from the seat to support a seated person's back, and a rear surface;

an orthopedic support pillow disposed within the back support between said front and rear surfaces thereof; and means for rotating said pillow about a longitudinal axis thereof extending substantially parallel to the seat so that the pillow causes a portion of the front support surface to bulge outward and create a support portion engagable with a part of the seated person's back, wherein said rotating means includes a rigid shaft extending through the pillow along the axis thereof and having a handle at at least one end of the shaft, said handle being manually grasped to rotate the same and thereby the pillow, wherein such shaft is a flat bar, said rotational axis being eccentric with respect to an exterior surface of said pillow such that rotation of said pillow through predetermined angular intervals causes the shape of the bulge to change, wherein the back support includes frontal and back covers respectively defining said front and rear support surfaces, said covers including a space therebetween extending vertically through the height of the back support and being open at least along one common side of said covers to facilitate manual placement of said pillow at a desired height in said back support between said covers, and further including notches forming anchorage bays located at discrete vertically spaced positions in the back support to anchor said pillow at a desired height.

2. The chair of claims 1, wherein said rotating means enables said pillow to rotate into four different predetermined angular intervals to define bulges of different sizes.

3. The chair of claim 2, wherein said intervals are at 90° intervals.

4. The chair of claim 1, wherein said shaft is of non-circular cross-section and embedded inside said pillow to induce rotation thereof.

* * * * *